US009064457B2

(12) United States Patent
Kawabe

(10) Patent No.: US 9,064,457 B2
(45) Date of Patent: Jun. 23, 2015

(54) PIXEL CIRCUIT AND DISPLAY DEVICE

(75) Inventor: Kazuyoshi Kawabe, Kanagawa (JP)

(73) Assignee: Global OLED Technology LLC

( * ) Notice: Subject to any disclaimer, the term of this patent is extended or adjusted under 35 U.S.C. 154(b) by 282 days.

(21) Appl. No.: 13/499,527

(22) PCT Filed: Oct. 6, 2010

(86) PCT No.: PCT/US2010/051581

§ 371 (c)(1),
(2), (4) Date: Jul. 23, 2012

(87) PCT Pub. No.: WO2011/044200

PCT Pub. Date: Apr. 14, 2011

(65) Prior Publication Data

US 2012/0280962 A1 Nov. 8, 2012

(30) Foreign Application Priority Data

Oct. 8, 2009 (JP) ..... 2009-234584

(51) Int. Cl.

| | |
|---|---|
| ***G09G 3/30*** | (2006.01) |
| ***G09G 3/36*** | (2006.01) |
| ***G09G 3/32*** | (2006.01) |
| ***G09G 3/34*** | (2006.01) |
| *G09G 3/20* | (2006.01) |

(52) U.S. Cl.

CPC ..... *G09G 3/3233* (2013.01); *G09G 3/2025* (2013.01); *G09G 3/2081* (2013.01); *G09G 3/344* (2013.01); *G09G 3/3648* (2013.01); *G09G 2300/023* (2013.01); *G09G 2300/0828* (2013.01); *G09G 2300/0852* (2013.01); *G09G 2310/0297* (2013.01)

(58) Field of Classification Search

CPC ..... G09G 5/00; G09G 3/30; G09G 3/10; G09G 3/2011–3/2018

USPC ..... 345/135–137, 76, 92, 211

See application file for complete search history.

(56) References Cited

U.S. PATENT DOCUMENTS

| | | | | |
|---|---|---|---|---|
| 5,432,898 | A * | 7/1995 | Curb et al. | 345/443 |
| 6,229,506 | B1 | 5/2001 | Dawson et al. | |
| 6,498,438 | B1 * | 12/2002 | Edwards | 315/169.3 |
| 7,221,351 | B2 | 5/2007 | Senda | |

(Continued)

FOREIGN PATENT DOCUMENTS

| | | | |
|---|---|---|---|
| JP | 2002-514320 | A | 5/2002 |
| WO | WO 2007120475 | A2 * | 10/2007 |
| WO | WO 2009/117090 | A1 | 9/2009 |

*Primary Examiner* — Amr Awad
*Assistant Examiner* — Wing Chow
(74) *Attorney, Agent, or Firm* — Global OLED Technology LLC

(57) ABSTRACT

[Problem to be solved] Obtain a constitution for a data driver which does not easily affected by transistor characteristics. [Solution] A plurality of coupling capacitances 7 is connected to data enable lines which is equipped to at least two set potentials. A plurality of bit transistors 6 which is turned on and off in accordance with the display data of a plurality of bits controls the relation of connection between a plurality of coupling capacitances and data enable lines to control the total capacitance of the said plurality of coupling capacitances. Display element operates in accordance with the voltage accumulated to the total capacitance of the said coupling capacitance according to the difference between the two set potentials equipped to the data enable line. By the operations above, a display is controlled by multi-bit display data per each pixel.

1 Claim, 10 Drawing Sheets

(56) References Cited

U.S. PATENT DOCUMENTS

2006/0022909 A1* 2/2006 Kwak et al. ..... 345/76
2006/0232520 A1* 10/2006 Park et al. ..... 345/76
2007/0236440 A1* 10/2007 Wacyk et al. ..... 345/92
2008/0001862 A1 1/2008 Kawabe
2008/0129906 A1 6/2008 Lin et al.
2009/0040212 A1 2/2009 Wang

* cited by examiner

PIXEL CIRCUIT AND DISPLAY DEVICE

This application is a National Stage Entry of International Application No. PCT/US2010/051581, filed Oct. 6, 2010 and claims the benefit of Japanese Application No. 2009-234584, filed on Oct. 8, 2009, both of which are hereby incorporated by reference for all purposes as if fully set forth herein.

TECHNICAL FIELD

The present invention relates to a pixel circuit and display device.

BACKGROUND ART

Organic EL is a self-emissive element which is capable of high contrast display and has fast response speed. For this reason, there is a high expectation for application as a next generation display which can display high-quality images. Organic EL element is sometimes driven by passive matrix, but active matrix type which uses a thin-film transistor (TFT) that is advantageous in producing high resolution is becoming popular in recent years. A display is produced using high quality thin-film transistor (TFT) such as low-temperature polysilicon to continuously drive organic EL element for long hours, but it is considered difficult under present circumstances to produce a display in a larger size at low cost because the production cost of low-temperature polysilicon is high. Thus, low-temperature polysilicon is put into a practical use mainly for a small size.

On the other hand, low temperature silicon TFT has a high mobility and long stability behavior, and can be used not only for pixels but also for driving circuit which behaves at a high speed. Therefore, a driving circuit (driver) for driving a select line or a data line is formed on a same glass substrate as pixels to omit a part of an electronic component such as a driver IC for an overall cost reduction.

However, lower-temperature polysilicon TFT has significantly variable Vth (threshold) and mobility characteristics. Thus, when TFT which drives organic EL is used in a saturated region (constant current drive), it is common to introduce a correction circuit within pixels. For example, as it is disclosed in patent reference 1, non-uniform display due to differences in characteristics of driving transistor can be improved by correcting Vth of driving transistor using a plurality of transistor.

PRIOR ART REFERENCES

Patent References

[Patent reference 1] Published Japanese translation of a PCT application No. 2002-514320

GENERAL DESCRIPTION OF THE INVENTION

Problems to be Solved by the Invention

In this prior art, generally a driver supplies analog electrical signals (for example, analog potential) to pixels. This is because it is difficult to constitute a driver which is capable of obtaining uniform analog potential on a glass substrate using a low-temperature polysilicon TFT which has significant variations in characteristics as explained above. Thus, when a driver is formed using a low-temperature polysilicon TFT, it is solely used in a digital circuit which is capable of switching select and non select like a select driver. For a further cost reduction, it is hoped that all drivers are made with TFT and driver ICs are eliminated.

Means for Solving the Problems

The present invention is a pixel circuit of a display device in which display is controlled by a display data having a plurality of bits, comprising a plurality of coupling capacitances connected to a data enable line set up by at least two potentials; a plurality of bit transistors for selecting on and off in response to a display data having a plurality of bits and controlling connection between a plurality of coupling capacitances and a data enable line in order to control a total capacity of the said plurality of coupling capacitances; and a display element which behaves in response to voltage accumulated to a total capacity of the said coupling capacitances in accordance with differences between two set voltages which is set by the said data enable line.

Also, the said display element is an organic EL element, and it is preferred that it comprises a driving transistor for providing current to the organic EL element, and the driving current of the said organic EL element is controlled by deciding the gate voltage of the driving transistor according to the voltage accumulated to a total capacity of the said coupling capacitances.

It is preferred that it further comprises a plurality of coupling capacitances with a relation of connection controlled by the said plurality of bit transistors; a selection transistor for controlling a gate connection of the said driving transistor; a retentive capacitance for connecting between source and gate of the said driving transistor; a reset transistor for controlling a connection between source and drain of the said driving transistor; and a light emission control transistor for controlling a connection between a drain of the said driving transistor and the said organic EL element, and a voltage corresponding to the threshold voltage of the said driving transistor is retained by the said retention capacity when the said light emission control transistor is turned off and the said reset transistor is turned on, and then a voltage accumulated to the total capacity of the said plurality of coupling capacitances is applied to the gate of the driving transistor.

Also, the said display element is a voltage controlled display element. It is preferred that a voltage accumulated to the total capacity of the said plurality of coupling capacitances is applied to the voltage controlled display element.

Also, it is preferred that it further comprises a plurality of coupling capacitances with a relation of connection controlled by the said plurality of bit transistors; a retentive capacitance which is connected in parallel to the said voltage controlled display element; and a reset transistor for controlling the connection between the connecting point of the said selection transistor and the said plurality of coupling capacitances and a constant voltage source, and the voltage accumulated to a total capacity of the said coupling capacitance is applied to the voltage controlled display element in accordance with differences between two set voltages which is set by the said data enable line under the condition of the said reset transistor is turned on and the same voltage is supplied to both ends of the said plurality of coupling capacitances to reset the charging voltage of the said plurality of coupling capacitances and subsequently said reset transistor is turned off and said selection transistor is turned on.

Also, the present invention is a display device comprising display elements for each pixel arranged in a matrix comprising: a data enable line set up by at least two potentials; a plurality of bit lines for transmitting display data having a plurality of bits per bit, and one pixel in a predetermined number of pixels comprises: a plurality of coupling capacitances connected to a data enable line; a plurality of bit transistors for selecting on and off in response to a display data having a plurality of bits and controlling connection between a plurality of coupling capacitances and a data enable line in order to control a total capacity of the said plurality of coupling capacitances; and a display element which behaves in response to voltage accumulated to a total capacity of the said coupling capacitances in accordance with differences between two set voltages which is set by the said data enable line.

Also the said predetermined number is 1 and it is preferred that each pixel comprises a plurality of coupling capacitances and a plurality of bit transistors.

Also, the said predetermined number is more than one and it is preferred that voltage for driving display elements for other pixels is accumulated by a plurality of coupling capacitances of one pixel and a plurality of bit transistors.

Also, it is preferred that the said one pixel and the other pixels are display elements having a different color from each other.

Also it is preferred that the said one pixel and the other pixels are pixels for displaying high-order bit data and pixels for displaying low-order bit data.

Advantages of the Invention

According to the present invention, it becomes unnecessary to consider variation of threshold value of a transistor in a data driver arranged outside of a display area because a pixel is equipped with a DA conversion function, and it becomes easy to constitute a driver with TFT.

MODE FOR CARRYING OUT THE INVENTION

An embodiment of the present invention will be explained based on the figures below.

Figure 1:
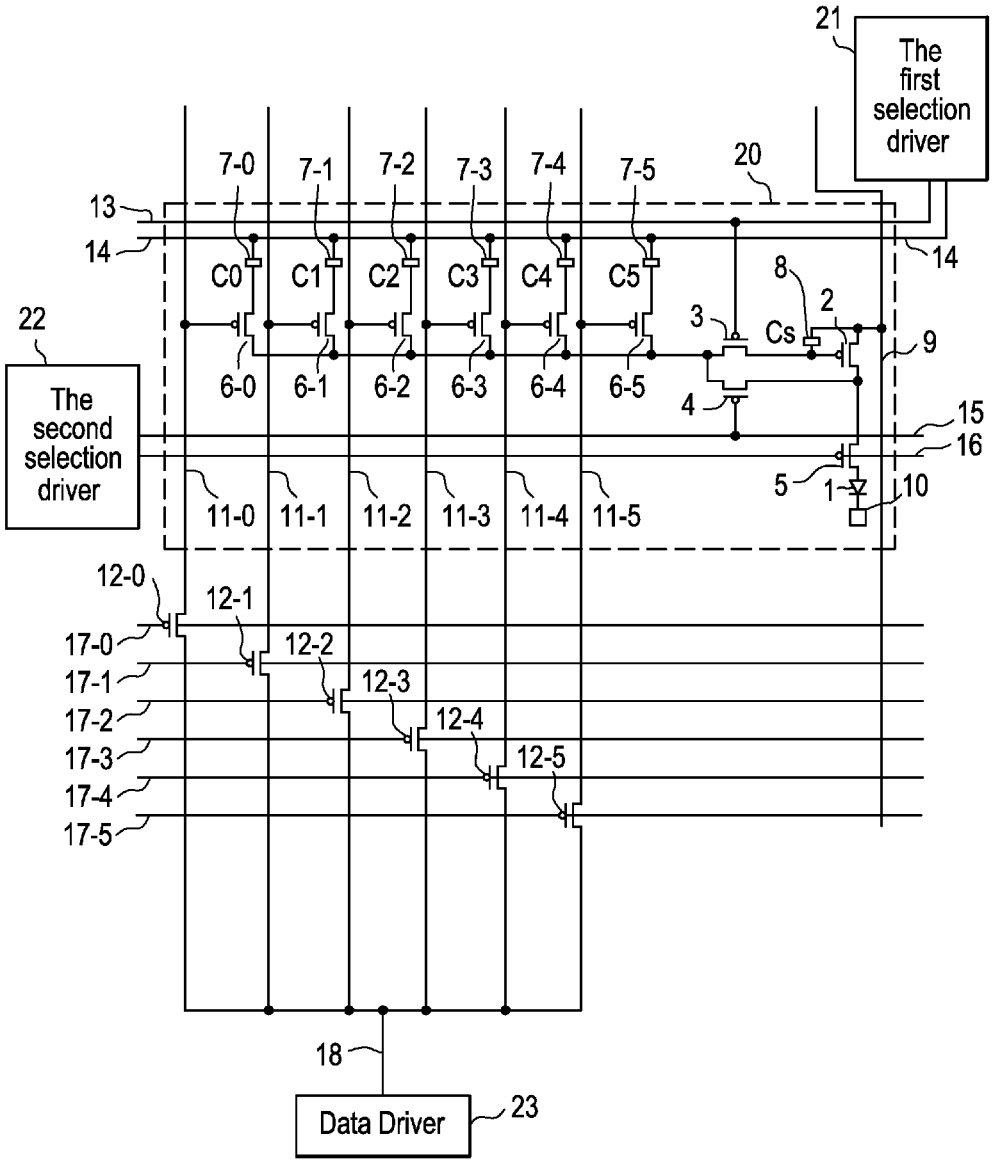
FIG. 1 is a diagram showing a schematic configuration of a pixel circuit and a display device containing the same of an embodiment.

FIG. 1 indicates a schematic configuration of a DAC built-in pixel circuit and a display device containing the same of this embodiment. In a 6-bit DAC built-in pixel 20, an organic EL element 1 as a display element is connected to a drain terminal of a light emission control transistor 5 with a cathode being connected to a cathode electrode 10 (constant potential VSS is given) common to all pixels and with a gate terminal of an anode being connected to a light emission control line 16. A source terminal of the light emission control transistor 5 is connected to a drain terminal of a driving transistor 2 with a source drain being connected to a power supply line 9 (constant potential VDD is given), and the connecting point is connected to a source terminal of a reset transistor 4 with a gate terminal being connected to a reset line 15. The drain terminal of the reset transistor 4 is connected to a drain terminal of a bit transistors 6-0 to 6-5 with a gate terminal connected to bit 0 to bit 5 of bit lines 11-0 to 11-5 respectively and to a drain terminal of a selection transistor 3 with a gate terminal being connected to a selection line 13. Each source drain of bit transistors 6-0 to 6-5 are connected to one end of coupling capacitances 7-0 to 7-5 with the other end connected to a data enable line 14. The source drain of the selection transistor 3 is connected to one end of a retentive capacitance 8 with the other end and the gate terminal of the driving transistor 2 being connected to the power supply line 9. Here, the capacitance value of the coupling capacitances 7-0 to 7-5 is constituted to satisfy C0:C1:C2:C3:C4:C5=1:2:4:8:16:32.

The selection line 13 and the data enable line 14 are driven by a first selection driver 21, and the reset line 15 and the light emission control line 16 are driven by a second driver. Selection drivers 21, 22 may not necessarily be separated into first and second drivers as in FIG. 1, and one selection driver may drive all four lines.

Bit lines 11-0 to 11-5 are connected to a data line 18 via multiplexers 12-0 to 12-15 with each bit line controlled by multiplex lines 17-0 to 17-5. Output from a data driver 23 is switched by the multiplexers 12-0 to 12-15 and supplied to each bit line. For example, when bit data is continuously output in a time-division manner from bit 0 to bit 5 from the data driver 23, bit data is supplied to corresponding bit lines by selecting multiplex lines from 17-0 to 17-5 in accordance with the timing, and bit transistors 6-0 to 6-5 are turned on and off according to bit data.

As explained above, one data line 18 can access 6 bit lines 11-0 to 11-5 using the multiplexer 12. Consequently, the number of output from the data driver 23 can be reduced. The number of output from the data driver 23 can be reduced by multiplexers 12-0 to 12-5 and the data driver 23 can be simplified, but it is possible to eliminate the multiplexer. That is, output from data driver 23 may be prepared in the same number as bit lines to directly connect bit lines 11-0 to 11-5.

Figure 2:
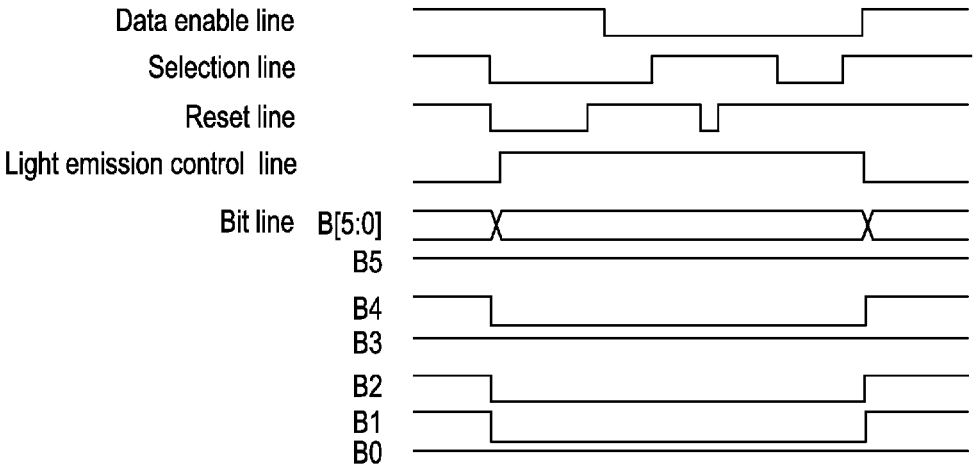
FIG. 2 is a timing chart indicating behaviors of a pixel circuit.

As explained above, when each bit data is supplied to the bit lines 11-0 to 11-5 using the multiplexer 12, the bit lines 11-0 to 11-5 are, for example, in the condition illustrated in FIG. 2 (B0 to B5). In this example, bit data to be input in pixels is "22(010110)" out of 6-bit 64 gradation (bit display in the parenthesis) and is made correspondent to on and off of a P-type transistor, by outputting its complementary data "41 (101001)" from the data driver 23 and retaining it in each bit line. That is, "0" in the complementary data indicate Low potential which turns on the bit transistor 6, and "1" indicate High potential which turns off the bit transistor 6. Consequently the total value of the data enable line 14 and the coupling capacitances are expressed in the following equations: CC=C1+C2+C4=22C0

A method of driving pixels will be explained in reference to FIG. 2. First, when the potential of the data enable line 14 is set to Vref, the selection line 13 and the reset line 15 are set to Low, and the selection transistor 3 and the reset transistor 4 are turned on, the gate terminal and the drain terminal of the driving transistor 2 are diode-connected to apply the current to the organic EL element 1. Next, when the light emission control line 16 is set to High and the light emission control transistor 5 is turned off, the current applied to the organic EL element 1 is shut off and the drain potential of the driving transistor 2 becomes closer to the potential to which the current is not applied, that is, Vth. The final potential, Vth, is written to the retentive capacitance 8 and Vref−(Vdd−Vth) is written to the coupling capacitance 7 (in this example, a total of capacitances 7-1, 7-2, 7-4 is CC=22C0) because the data enable line 14 is maintained to Vref.

Next, the reset line 15 is set to High while the selection line 13 is Low. After the reset transistor 4 is turned off and the potential of the coupling capacitance 7 is fixed, when the data enable line 14 is Vdat (Vdat<Vref), the gate potential of the driving transistor 2 is expressed in the following Equation 1.

$$Vg = Vdd - \frac{Cc}{Cc + Cs}(Vref - Vdat) - Vth \quad \text{[Equation 1]}$$

Thus, the gate and source potential of the driving transistor 2 becomes as indicated in Equation 2:

$$Vgs = Vdd - Vg = \frac{Cc}{Cc + Cs}(Vref - Vdat) + Vth \quad \text{[Equation 2]}$$

The potential between the gate and source of the driving transistor 2 is a potential with Vth being added at all time.

With this condition, the selection line 13 is set to High and the selection transistor 3 is turned off to fix the gate potential of the driving transistor 2, and the driving transistor 2 behaves to apply a drain current Ids indicated in Equation 3.

$$Ids = \beta(Vgs - Vth)^2 = \beta\left\{\frac{Cc}{(Cc + Cs)}(Vref - Vdat)\right\}^2 \quad \text{[Equation 3]}$$

However, $$\beta = \frac{1}{2}\mu Cox\frac{W}{L} \quad \text{[Equation 4]}$$

Here, μ is mobility, Cox is a gate insulator capacitance, W and L are channel width and channel length respectively of the transistors.

As is clear from Equations 3, 4, the effect of Vth is cancelled in the drain current Ids because of the Vth correction which is mentioned above. However, the mobility μ (included in β) remains as a parameter of the drain current Ids and the effect of the variation cannot be simply excluded only with the Vth correction.

Therefore, the drain current Ids which received the effect of variation in the mobility μ is read out by the coupling capacitance 7 by maintaining the data enable line 14 to Vdat, setting the selection line 13 to High, keeping the selection transistor 3 turned off, setting the reset line 15 to Low, and turning the reset transistor on only during the read out period Δt. Δt is short enough as a period for the driving transistor 2 to keep operating in the saturated region. The current which was read out is converted to a voltage as in Equation 5 and retained in the coupling capacitance 7.

$$\Delta V = \frac{Ids\Delta t}{Cc} \quad \text{[Equation 5]}$$

When the selection transistor 3 is turned on while the selection line 13 is set to Low again, the differences of potentials ΔV by the read-out drain current is reflected to the gate potential of the driving transistor 2, and the gate potential receives a negative feedback (mobility correction) as expressed in Equation 6.

$$Vgs = Vdd - Vg = \frac{Cc}{Cc + Cs}(Vref - Vdat) + Vth - \Delta V \quad \text{[Equation 6]}$$

That is, when the mobility μ has a relatively large variations, the drain current Ids after Vth correction becomes larger, and consequently ΔV becomes large. On the other hand when the mobility has a relatively small variations, the drain current Ids after Vth correction becomes small, and consequently ΔV becomes small. As the result, the final drain current Ids' after the mobility correction is as expressed in Equation 7:

$$Ids = \beta\left\{\frac{Cc}{(Cc + Cs)}(Vref - Vdat) - \Delta V\right\}^2 \quad \text{[Equation 7]}$$

According to Equation 5, ΔV depends on the read out period Δt, and thus the drain current Ids' after the mobility correction also depends on the read out period Δt. The best read out period Δt to further stabilize the drain current Ids' after the mobility correction against the variation of mobility μ (variation of β) is derived.

When Equation 7 is differentiated by β and rearranged, it becomes Equation 8.

$$\frac{\partial Ids}{\partial \beta} = V^2\left\{1 - \frac{\beta\Delta t}{Cc + Cs}(Vref - Vdat)\right\}\left\{1 - \frac{3\beta\Delta t}{Cc + Cs}(Vref - Vdat)\right\} \quad \text{[Equation 8]}$$

Figure 9:
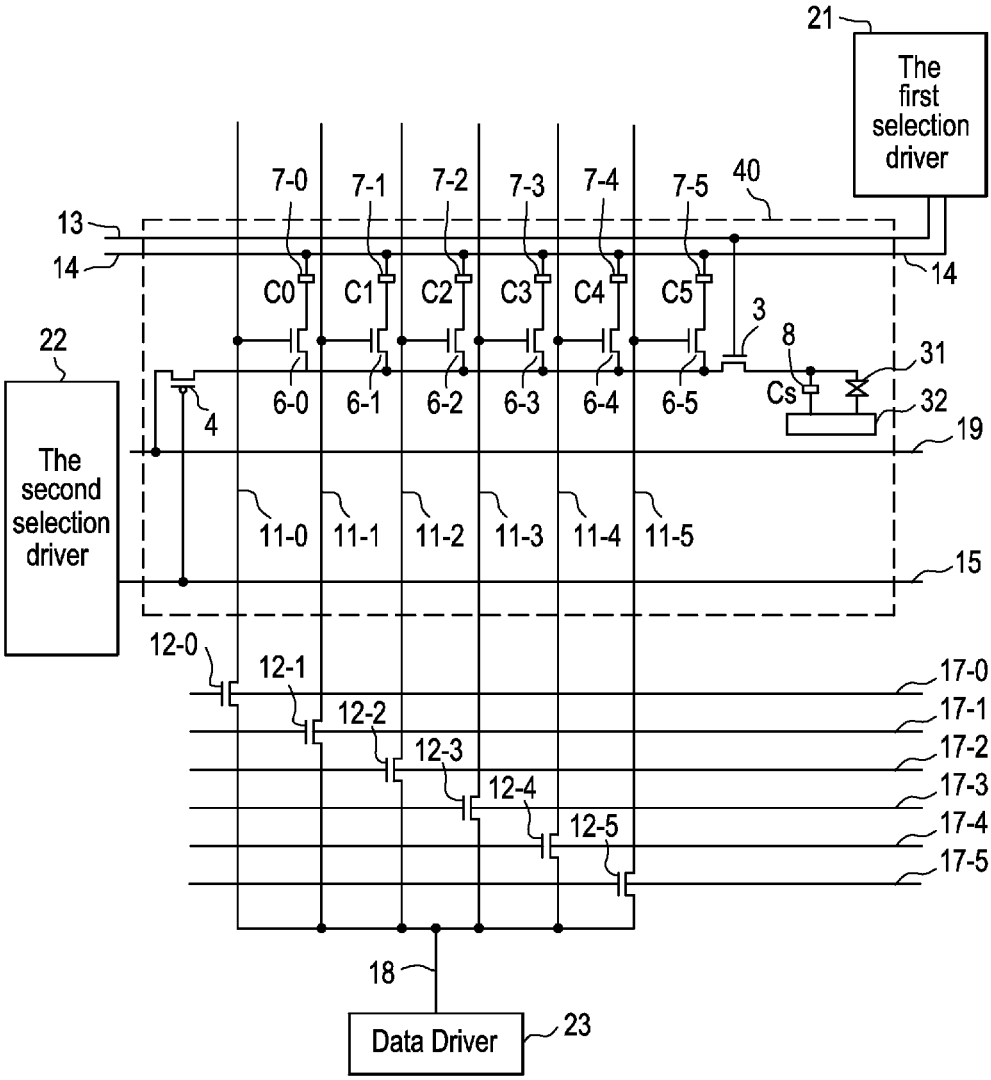
FIG. 9 is a schematic configuration of a display device having voltage controlled elements as display elements.

Thus, the derivative of Equation 8 becomes 0 and the condition of Δt with the smallest variations of drain current against the variations of mobility μ is derived as in FIG. 9.

$$\Delta t = \frac{Cc + Cs}{3\beta(Vref - Vdat)} \quad \text{[Equation 9]}$$

According to Equation 7, the drain current Ids' becomes smaller as ΔV becomes greater, but when Δt satisfies Equation 9, the derivative becomes 0 and Ids' indicates the maximum value. Consequently, the reduction in current can be kept to the minimum.

By substituting Equation 9 into Equation 7 and rearranging it, the drain current after optimal mobility correction is obtained as in Equation 10.

$$Ids = \frac{4}{9}\beta\left\{\frac{Cc}{(Cc + Cs)}(Vref - Vdat)\right\}^2 \quad \text{[Equation 10]}$$

However, in reality, while the reset line 15 is on at mobility correction, controlling of Δt is conducted on a line by line basis and therefore it is impossible to set an optimal value in accordance with coupling capacitance value CC as in Equation 9. That is, pixels (bright pixels and dark pixels) of coupling capacitance value CC which varies in accordance with bit data exist in 1 line, but it is impossible to set an optimal Δt to all pixels in 1 line. Therefore, Δt is set to achieve an optimal duration with a certain reference value such as a value having a coupling capacitance value CC, for example, a coupling capacitance value CC which makes 80% of the peak current.

As described above, after mobility is corrected by Vth and optimal Δt, current is applied to organic EL element 1 to emit light by setting the selection line 13 as High and the light emission control line 16 as Low. When this is repeated in all lines, correction for one screen is completed and an even image without variations in Vth and mobility is displayed.

Figure 3:
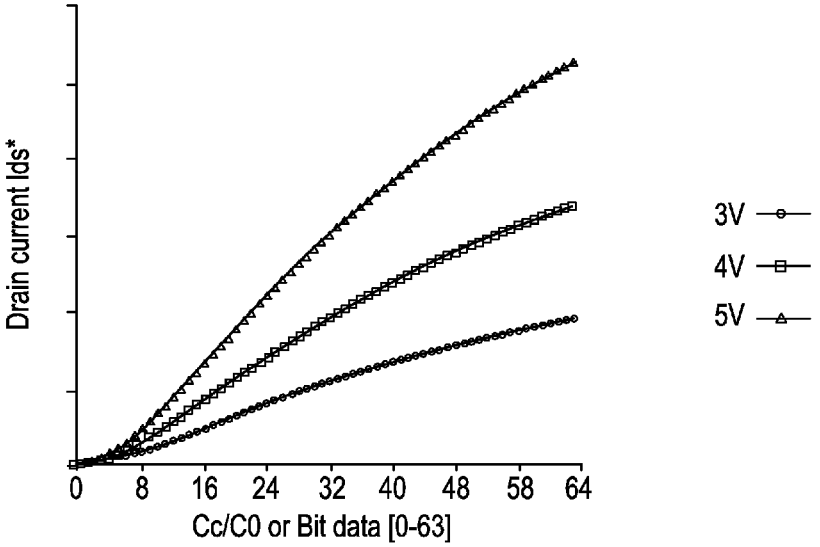
FIG. 3 is a diagram showing DA conversion characteristics when enable voltage is changed to 3-5V.

In the case of pixels with a built-in DAC as in FIG. 1, unlike conventional pixel circuits, the coupling capacitance value CC is modified by turning on and off the bit transistors 6-0 to 6-5 using the bit data retained in the bit lines 11-0 to 11-5. That is, the drain current Ids' is controlled by the CC values. The relationship between the bit data or the coupling capacitance value CC and the drain current Ids' is illustrated in FIG. 3 based on the Equation 10. This indicates the DA conversion characteristic of pixels in FIG. 1.

In the example of FIG. 2, "22" is input as a bit data and the coupling capacitance value becomes Cc=22C0 (Cc/C0=22), and its corresponding drain current Ids' is decided.

FIG. 3 indicates the drain current Ids' when Vref−Vdat, that is, when the enable voltage of the data enable line 14 is modified from 3V to 5V, that is, DA conversion characteristic.

Although DA characteristics is determined when the coupling capacitances 7-0 to 7-5 of capacitance values C0 to C5 of bit 0 to bit 5, it is clear that the peak current can be changed by modifying the enable voltage Vref−Vdat of the data enable line. This is convenient for brightening a screen by setting the desired peak current high or darkening a screen by setting the desired peak current low. This is because the peak current (brightness) can be converted without deteriorating image quality as DA characteristics can maintain 6 bits even when the peak current is modified.

Moreover, it can be understood from Equation 10 that even the DA conversion characteristics can be modified by changing the ratio of the coupling capacitance value CC and the retentive capacitance Cs. When the coupling capacitance value Cc is larger compared to the retentive capacitance Cs, the drain current Ids' becomes an upward convex curve. On the other hand, when the coupling capacitance value Cc is smaller compared to the retentive capacitance Cs, the drain current Ids' becomes a downward convex curve. The drain current Ids' can also be changed by modifying the capacitance ratio, but it is adjustable with the enable voltage of the data enable line 14 as explained above. This function can be easily realized by placing a plurality of retentive capacitances 8 with one end connected to the power supply line 9 and the connection of the other end switched to connect the gate terminal of the driving transistor 2 through individually equipped transistors.

Also, the DAC built-in pixel 20 may be constituted by switching the placement of the coupling capacitance **7-*n* and the bit transistor 6-*n* (n=0 to 5). That is, the drain terminal of the bit transistor 6-*n* may be connected to the data enable line 14, one end of the coupling capacitance 7-*n* to the source terminal, and the other end to the connecting point of the drain terminal of the selection transistor 3 and the reset transistor 4. Or, when there is no need to correct the mobility of the driving transistor 2, that is, when Vth correction only is sufficient, the DAC built-in pixel 20 may be constituted by connecting the drain terminal of the reset transistor 4 to the gate terminal of the driving transistor 2**.

Although only P-style transistors are used in FIG. 1, N-style transistors may be used as some or all of transistors in this constitution. In this case, reverse the High and Low of the polarity of the driving waveform in FIG. 2 against the polarity of the transistors.

In the pixel circuit of FIG. 1, it may be difficult to secure the luminescent area of the organic EL element 1 because of the complexity of installing DAC to each pixel. However, the pixel circuit can be simplified by sharing DAC with RGB pixels (20R, 20G, 20B) as in FIG. 4.

Figure 4:
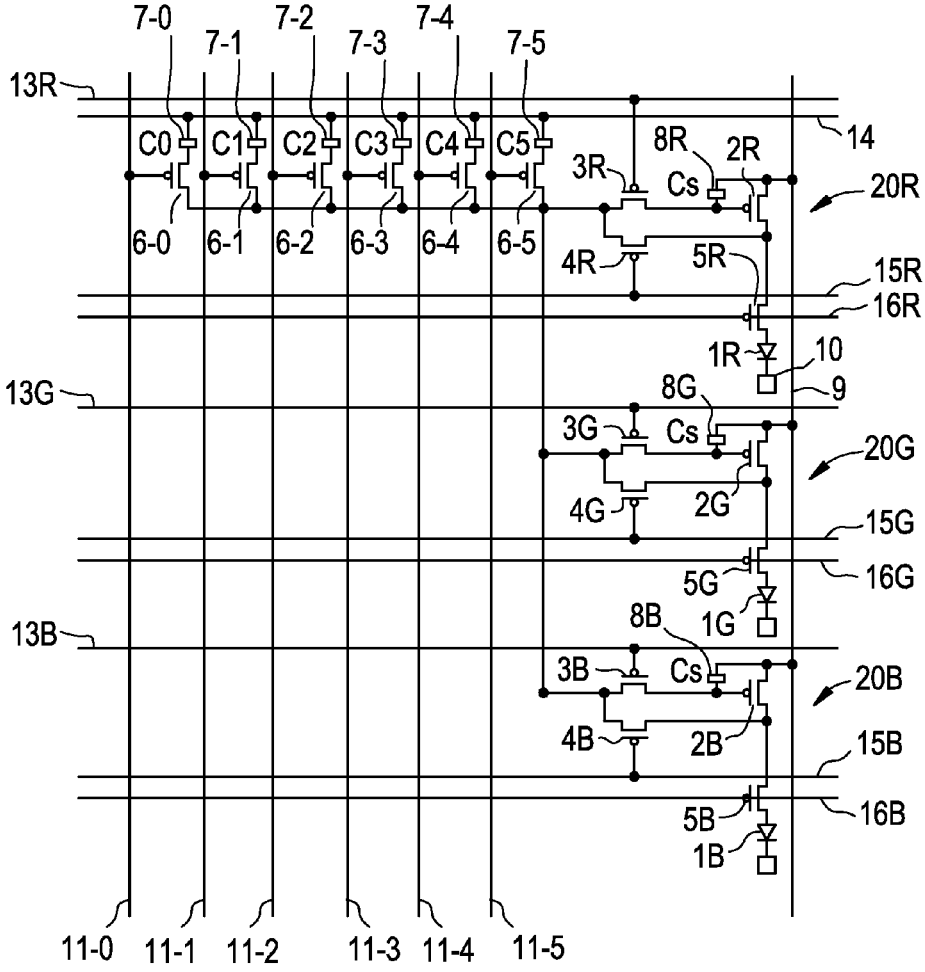
FIG. 4 is a diagram indicating a constitution of a pixel circuit which shares a DA converter with RGB pixels (20R, 20G, 20B).

FIG. 4 illustrates an example of full color unit pixel (pixels comprising RGB) with a part of DAC comprising the coupling capacitances 7-0 to 7-5 and the bit transistors 6-0 to 6-5 being shared with RGB pixels. As a full color pixel, W (white) may be added to RGB. The connecting points between the drain terminal of the selection transistors 3R, 3G, 3B of each RGB pixel and the drain terminal of the reset transistors 4R, 4G, 4B are connected to the source terminal of each bit transistors 6-0 to 6-5. When writing data, the procedures of FIG. 2 are, for example, done in the order of RGB. That is, Vth correction of R pixel 20R, writing of data, and mobility correction are executed first, Vth correction of G pixel 20G, writing of data, and mobility correction are carried out next, and lastly Vth correction of B pixel 20B, writing of data, and mobility correction are executed to complete writing of 1 line of full color pixels. Instead of arranging pixels in parallel for 3 pixels RGB to write RGB data at once as in Fig, this is a mechanism to obtain the same effect by repeating the same procedures as in FIG. 2 by separating into 3 steps per each pixel of RGB.

Although a total of 3 procedures are necessary for each color because Vth correction and motility correction are executed per each pixel, the number of bit lines which are necessary for DAC and its control can be reduced significantly. As the results, a pixel with a compact constitution is achieved. When each pixel of RGB is written, the peak current of RGB can be modified by making the voltage level of Vdat different in each color. With this method, it is easy to maintain a picture quality because chromaticity of each color can be adjusted to desired white point by changing the peak current of each color even when the chromaticity of each color varies in manufacturing process.

Figure 5:
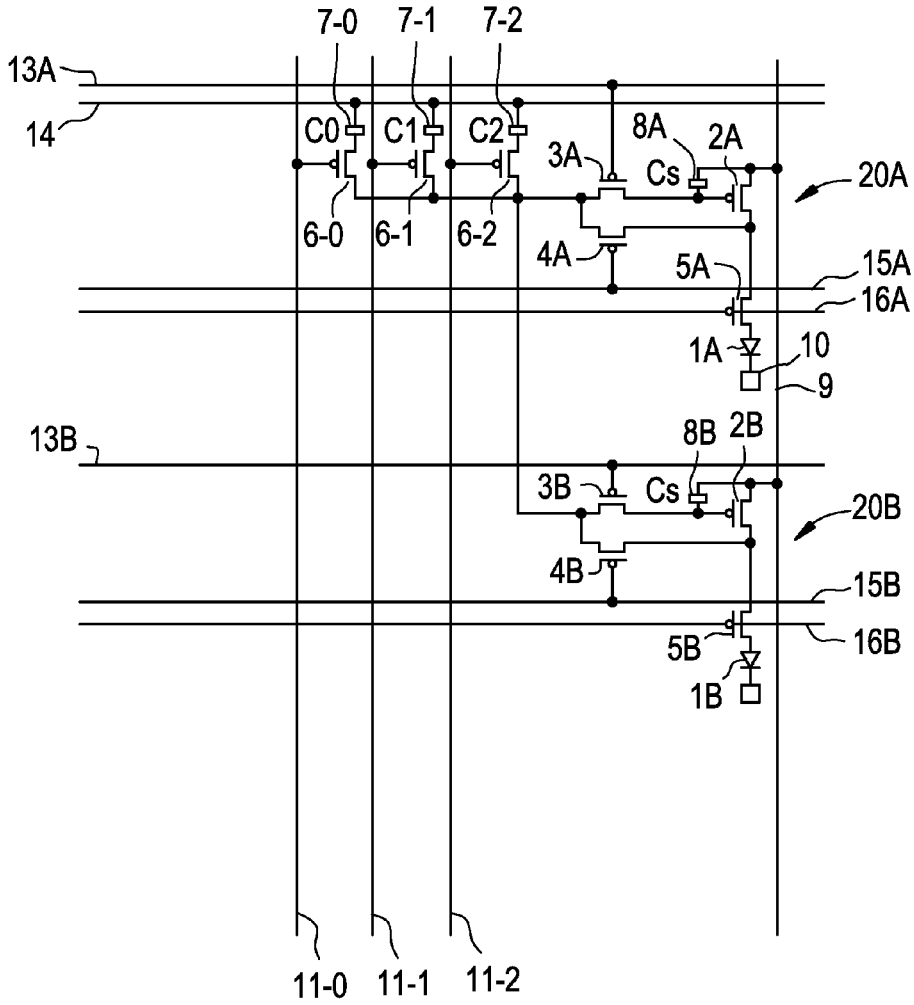
FIG. 5 is a diagram showing a constitution of a pixel circuit which shares a DA converter in sub pixels.

FIG. 5 shows an example of DAC built-in pixel circuit with a part of DAC simplified by sub pixels. In the example of FIG. 5, 1 pixel (any of RGB) is divided into two sub pixels, 20A and 20B and one 3-bit DAC is shared by two sub pixels. The sub pixel 20A is in charge of displaying bits 5 to 3 (high-order bit) while the sub pixel B is in charge of displaying bits 2 to 0 (low-order bit). In order for each sub pixel to display high-order bit and low-order bit separately, drain current must be generated in the ration of 8:1 for high-order bit and low-order, and there are some ways to realize it. First method is to modify the size of the driving transistor 2 within sub pixels. By doing so, the drain current can be modified within the same gate potential. For example, by making the channel width of the driving transistor 2A 8 times greater than the driving transistor 2B or by making the channel length ⅛, the current is simply multiplied by 8.

The current ratio may be adjusted by changing the enable voltage of the data enable line 14 as indicated in FIG. 3 without changing the size of the driving transistor 2. That is, keep the value of Vref of the data enable line 14 the same but set the potentials of Vdat of the data enable line 14 when data is written different from that of when the pixel 20 is written and from when the pixel 20B is written. Make Vdat of the data enable line 14 when data is written into the pixel 20A lower than when data is written into the pixel 20B, and make the enable voltage Vref−Vdat higher in order to adjust the current ratio as 8:1. By doing so, the potential of Vdat can be adjusted to set a current ratio and thus there is a lot of flexibility and operability is improved.

Writing of data is carried out in two steps. For example, first the high-order 3 bits are supplied from the pixel 20A which corresponds to high-order bits to the bit lines 11-0 to 11-2, and after Vth correction, data is written with lower Vdat to correct mobility. Next, low-order 3 bits are supplied to the bit lines 11-0 to 11-2, and after Vth correction of the pixel 20B, data is written with higher Vdat to correct mobility. As explained above, a pixel circuit can be made compactly by placing sub pixels and having a common DAC to reduce bit number of DAC of each sub pixel. The number of sub pixels may be 3 or more, and when it is more than 3, the number of bit of DAC is further reduced or number of gradation can be increased with a small-scale DAC.

Also, the luminescent area of sub pixels may be changed by the sub pixel 20A of high-order bit display and the sub pixel 20B of low-order bit display. For example, the sub pixel 20A of high-order bit can be made about 8 times larger than the sub pixel 20B of low-order bit. By doing so, the current density of the sub pixel 20A of high-order bit can be controlled to prevent organic EL elements from deteriorating. The sub pixel 20B of low-order bit has a small current stress from the beginning and thus there is no need to secure an opening area beyond necessity.

Even when the opening area is the same for the low-order sub pixels and the high-order sub pixels, the degree of deterioration may be equalized by switching the high-order and low-order back and forth. For example, in odd-number frames, greater amount of current is applied considering the sub pixel 20A as high-order bit pixels while driving the sub pixel 20*b* as low-order bit pixels with small amount of current. In even-number frames, greater amount of current is applied considering the sub pixel 20B as high-order bit pixels while driving the sub pixel 20A as low bit pixels with a small amount of current. By doing so, deterioration becomes even between sub pixels because even current is applied back and forth.

Figure 6:
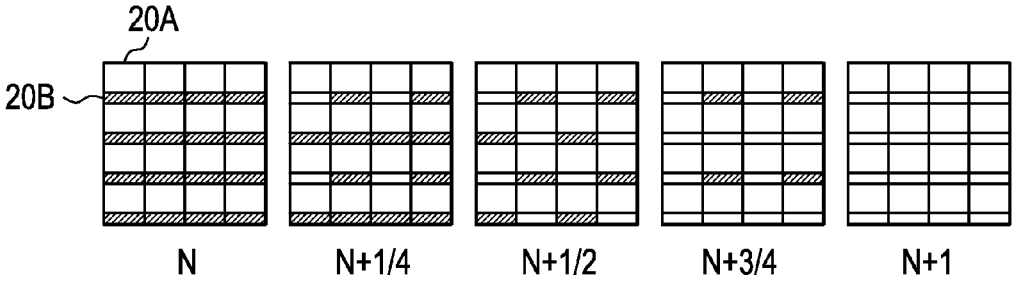
FIG. 6 is an explanatory diagram of a display condition of sub pixels.

The advantage of introducing sub pixels as in FIG. 5 is not only to simplify a pixel circuit but also to improve number of pseudo gradation. FIG. 6 indicates an example of it. A gradation N and a gradation N+1 are continuous gradation when 6-bit gradation is displayed and are displayed by an increment of gradation of low-order bit display sub pixel 20B. By making the gradation of the sub pixel 20B different from the neighboring upper, lower, left and right sub pixels 20B, a gradation which cannot be reproduced under normal conditions can be pseudo displayed. For example, the sub pixel 20B in address 1 row 1 column and the sub pixel 20B in address 2 row 2 column are incremented by +1 to obtain the same effect as the display incremented by +½ with neighboring pixels and average value in the upper left 2×2 matrix (N+½). When only the sub pixel 20B in address row 1 column 1 is incremented by +1, the upper left 2×2 matrix becomes a display incremented by +¼ (N+¼), and when the sub pixel 20B in address row 1 column 1, row 2 column 1, row 2 column 2 are incremented by +1, the upper left 2×2 matrix can obtain the same effect as the display incremented by +¾ (N+¾). That is, the gradation display performance shows a pseudo 4-fold increase, that is, it becomes possible to display close to an 8-bit gradation with a 6-bit DAC. When the location of increment is switched on a frame by frame basis, luminance by increment is smoothed out by a plurality of frames and the lighting pixels become less visible. For example, in the case of N+¼, it is controlled so that the increment sub pixel in address row 1 column 1 is switched with any of the sub pixels in a 2×2 matrix including the same, and the order of lighting goes back to row 1 column 1 again after the forth frame in order to distribute lighting and to make the pattern of pseudo gradation less visible.

By such display method, display performance can be improved even in a simplified circuit constitution. Also, number of gradation can be increased by expanding the neighboring pixels from 2×2 to 3×3, and it is also possible to adjust by increasing the incrementing of sub pixel 20B from by +1 to by +2, +3. A pseudo gradation may be created between neighboring pixels in a similar method using the high-order bit sub pixel 20A, or a display may be made in combination of pseudo gradation of the high-order bit pixel 20A and pseudo gradation of the low-order bit pixel 20B.

Figure 7:
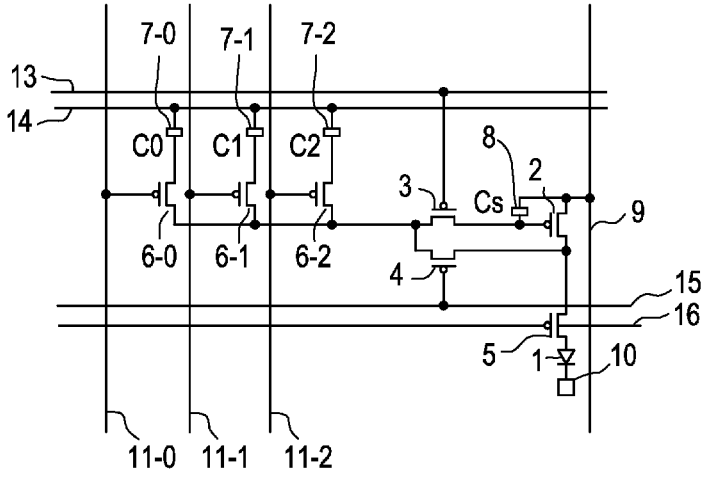
FIG. 7 is a diagram indicating a constructive example of a pixel circuit when a sub frame is used.
Figure 8A:
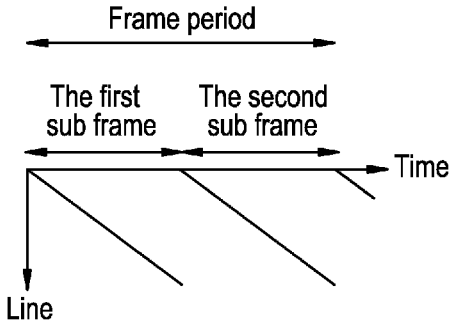
FIG. 8 is a diagram showing a display example of a sub frame of the constitution of FIG. 7.
Figure 8B:
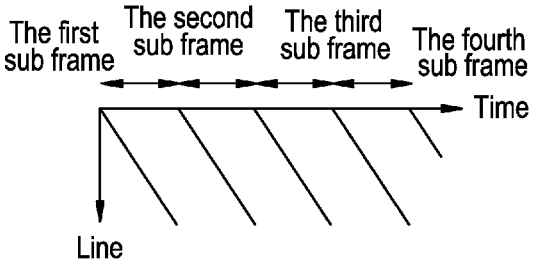
Figure 8C:
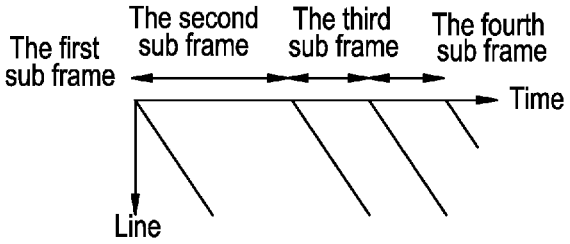

FIG. 7 indicates an example of other DAC built-in pixel circuit comprising a further simplified DAC. Although the example of FIG. 7 comprises a built-in DAC which is simplified to 3-bit, a driving method of achieving multiple bits using a sub frame is applied. FIG. 8 indicates an example of the sub frame. FIG. 8 (A) indicates an example of when 6-bit display is made with two sub frames to which equal display period is assigned. FIG. 8 (B) indicates an example of when 12-bit display is made with four sub frames to which equal display period is assigned.

When a 6-bit display of FIG. 8 (A) is made, the frame period is divided into two sub frames and the high-order bit is displayed in the first sub frame while the low-order bit is displayed in the second sub frame. First, in the first sub frame, the high-order bit data is supplied to the bit lines 11-0 to 11-2, Vth correction, writing of data, and mobility correction are carried out to display high-order bit. When data is written, Vdat is set lower and enable voltage Vref−Vdat is set to an appropriate value so that the driving transistor 2 can apply the current necessary to display high-order bit. First, in the second sub frame, the low-order bit data is supplied to the bit lines 11-0 to 11-2, and Vth correction, writing of data, and mobility correction are carried out to display low-order bit. When data is written, Vdat is set higher and the enable voltage Vref−Vdat is set so that the driving transistor 2 can apply an appropriate current to display low-order bit. That is, in the 6-bit display example of FIG. 8 (A), when high-order bit is displayed, Vdat is set to apply 8 times higher current than when the low-order bit is displayed.

By using 4 sub frames as in FIG. 8 (B), multi-gradation is further obtained. That is, 12-bit gradation can be generated using a 3-bit DAC. The high-order bits 11 to 9 out of 12 bits, the following bits 8 to 6, the following bits 5 to 3, and the low-order bit 2-0 are displayed in the first sub frame, in the second sub frame, in the third sub frame, and in the fourth sub frame respectively. In each sub frame, 3-bit data which corresponds to the bit lines 11-0 to 11-2 are supplied, and Vth correction, writing of data, mobility correction are carried out to display with the divided 3-bit gradation. Also, when data is written, different Vdat values are set to each sub frame. Vdat is the lowest in the high-order bit sub frame, and the Vdat value goes up as the bit moves lower. In other words, the enable voltage Vref−Vdat becomes smaller. By doing so, voltage is set to an appropriate value when each 3-bit display is made, and the current ratio is 512:64:8:1 from the high-order bit.

As shown in FIGS. 8 (A) and (B), sub frames may not necessarily be evenly divided period and it may be set to any period. For example, as in FIG. 8 (C), when a 9-bit display is made using 3 sub frames, if the period of the first sub frame is longer than the second and the third sub frames, for example by 2 times, the first sub frame can display the highest-order bit using the current of the second frame. Therefore, Vdat at writing, that is the enable voltage Vref−Vdat can be made equal in the first and second sub frames, and the number of voltage level prepared by the selection driver 21 for driving the data enable line 14 can be simplified. That is, 2 levels of Vdat is necessary in FIG. 8 (A) and 4 levels of Vdat is necessary in FIG. 8 (B), but 9-bit gradation can be displayed with 2 levels in FIG. 8 (C)

As in FIGS. 8 (A), (B), (C), when sub frames are introduced to obtain multi-gradation, a pixel circuit is further simplified because the bit number of DAC can be reduced, but frame memory is necessary as sub frames are used. Therefore, it is required that frame memory is introduced to an external control IC and system and is controlled so that bit data corresponding to each sub frame is output at the timing of sub frames.

As explained above, by introducing DAC to pixels, when digital data is input to the bit line 11, the digital data is analog converted and given to the gate terminal of the driving transistor 2, and the potential with corrected Vth and motility is obtained so that the data driver 23 can be constituted only with digital circuits. That is, an organic EL display can be constituted with digital circuits only, making it possible to eliminate an external IC such as a driver IC or to further simplify a driver IC.

The content of the description above can obtain the same effect not only when low-temperature polysilicon TFT is used but also when amorphous silicon TFT is used. It is also possible to use TFT constituted with other items such as an oxide semiconductor. Also, without being limited to an organic EL display, it can be applied to displays having different display characteristics such as liquid crystal and electronic paper.

FIG. 9 indicates an example of a pixel 40 with a built-in 6-bit DAC which comprises display element 31 such as liquid crystal and electronic paper with optical characteristics such as transmittance and reflectivity being controlled by voltage (voltage controlled display element). One end of the capacitive display element 31 corresponds to a common electrode 32 (equivalent to an opposite electrode and VCom, a common potential to all pixels, is given.) and the other end is connected to the source terminal of the selection transistor 3. One end of the retentive capacitance 8 with the other end corresponding to the common electrode 32 is connected to this source terminal and thus the retentive capacitance 8 operates as a capacitance which is constituted in parallel to the display element 31. That is, the retentive capacitance 8 maintains the potential difference which is given to the display element 31 for a certain period in order to continue to stably supply the same potential difference to the display potential 31 during the period. One end of the retentive capacitance 8 may not be an opposite electrode and may be connected to other wire.

The drain terminal of the bit transistors 6-0 to 6-5 with the gate terminal being connected to each bit lines 11-0 to 11-5 and the source terminal being connected to one end of each coupling capacitances 7-0 to 7-5 as well as the drain terminal of the reset transistor 4 are connected to the drain terminal of the selection transistor 3, and the gate terminal of the selection transistor 3 is connected to the selection line 13 to control on and off. The other end of the coupling capacitances 7-0 to 7-5 are connected to the data enable line 14 to control capacitance value CC which becomes active according to the condition of the bit lines 11-0 to 11-5. That is, the coupling capacitance CC is controlled in proportion to the bit data because the ratio of the capacitance values of the coupling capacitances 7-0 to 7-5 is given as C0:C1:C2:C3:C4:C5=1:2:4:8:16:32 as in the example of FIG. 2.

The source terminal of the reset transistor 4 is connected to the reference line 19 to which the common potential VCom is given, and the gate terminal is connected to the reset line 15 to control on and off.

In the example of FIG. 9, the selection line 13 and the data enable line 14 are driven by the first selection driver 21, and the reset line 15 is driven by the second selection driver 22, but they may be driven by the same selection driver.

Figure 10:
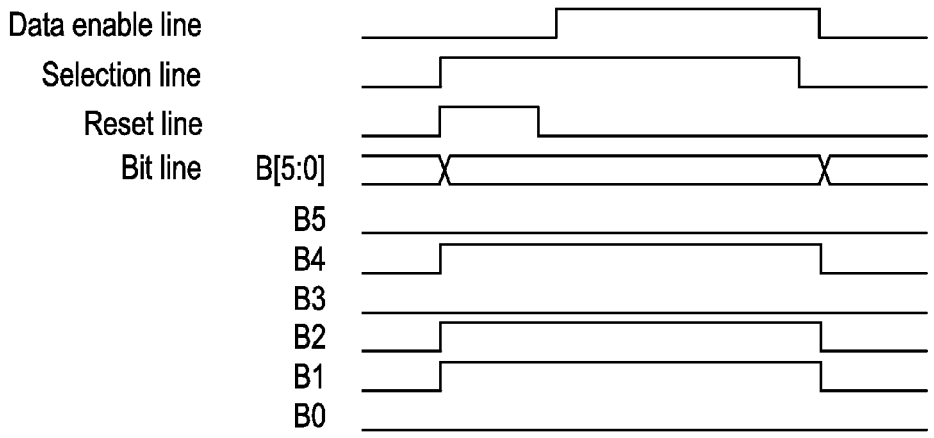
FIG. 10 is a timing chart indicating behaviors of a pixel circuit of FIG. 9.

The driving method and the control timing of each line are indicated in FIG. 10. First, the bit data which is output in order from the data driver 23 through the data line 18 is switched by the multiplexers 12-0 to 12-5 which is turned on and off based on the switch signal given to the multiplex lines 17-0 to 17-5, and supplied to the corresponding bit lines 11-0 to 11-5. Here, the same bit data "22 (010110)" as in FIG. 2 is input, the bit data is switched in the order of 0→1→0→1→1→0 from high-order bit and transferred to the bit lines 11-0 to 11-5, and the condition of each bit line becomes as in FIG. 10. By doing so, an active coupling capacitance is determined and the coupling capacitance with a capacitance value CC=22C0 is obtained as in the case of FIG. 2.

When the selection line 13 and the reset line 15 are set to High while proving Vref to the data enable line 14 under this condition, the selection transistor 3 and the reset transistor 4 turn on and the retentive capacitance 8 and the coupling capacitance 7 are reset. At this time, potential differences of 0 and VCom−Vref are generated to the retentive capacitance 8 and the coupling capacitance 7 (here, active coupling capacitances 7-1, 7-2, 7-4) respectively because a constant potential Vcom is supplied to the reference line 19 and the common electrode 32.

Next, after the reset line 15 is set to Low and the reset transistor 4 is turned off, when the data enable line 14 transits to Vdat, the source potential Vs of the selection transistor 3, that is, the potential of one end of the retentive capacitance 8 becomes as expressed in Equation 11.

$$Vs = Vcom + \frac{Cc}{Cc + Cs}(Vdat - Vref) \quad \text{[Equation 11]}$$

However, the capacitance of the display element 31 is presumed as small enough compared to the retentive capacitance 8 and is ignored here. As the result, potential difference Vopt of Equation 12 is applied to both ends of the display element 31 and optical characteristics is controlled based on this potential difference.

$$Vopt = \frac{Cc}{Cc + Cs}(Vdat - Vref) \quad \text{[Equation 12]}$$

As it is clear from Equation 12, the potential difference Vopt of the display element 31 is controlled by controlling the coupling capacitance value CC. Also, it is verified that the peak voltage is controlled by the potential difference Vdat−Vref of the data enable line 14. That is, the peak of Vopt becomes greater when Vdat−Vref becomes greater, while the peak of Vopt becomes smaller when it becomes smaller. Also it is possible to reverse the peak potential difference to a negative value by making the peak further smaller.

This reversing function is convenient when driving liquid crystal. It is because when the display element 31 is liquid crystal, it needs to be AC-driven at a constant frequency. This can be easily achieved by controlling the enable voltage of Vdat−Vref as indicated in Equation 12. That is, the driving voltage which is given to liquid crystal on a frame by frame basis is converted to AC by giving Vdat which satisfies Vdat−Vref>0 in odd number frames and giving Vdat which satisfies Vdat−Vref<0 in even number frames, and liquid crystal can be properly controlled (frame inversion drive). This control is switched on a line by line basis, that is, Vdat which satisfies Vdat−Vref>0 is given to odd number lines and Vdat which satisfies Vdat−Vref<0 is given to even number lines to be converted to AC in a line period. Also by switching and giving Vdat which satisfies Vdat−Vref>0 in even number lines and Vdat which satisfies Vdat−Vref<0 in odd number lines in the next frame, AC conversion is made on a frame to frame basis so that liquid crystal behaves properly (line inversion drive). AC conversion is maintained by switching such control on a frame to frame basis and a normal image display is made also in liquid crystal.

When the display element 31 is an electrophoretic element, the condition is stored to the display element 31 and therefore there is no need to write data repeatedly and also there is no need for AC conversions. Bit data is set to the bit lines 11-0 to 11-5 only when images are rewritten and Vopt is written in the retention capacitance 8.

In this case, the positions of the coupling capacitance 7 and the bit transistor 6 may be switched as the pixels in FIG. 1. That is, the drain terminal of the bit transistor 6 is connected to the data enable line 14 and one end of the coupling capacitance 7 is connected to the source terminal. The other end of the coupling capacitance 7 is connected to the connecting point of the reset transistor 4 and the drain terminal of the selection transistor 3.

Figure 11:
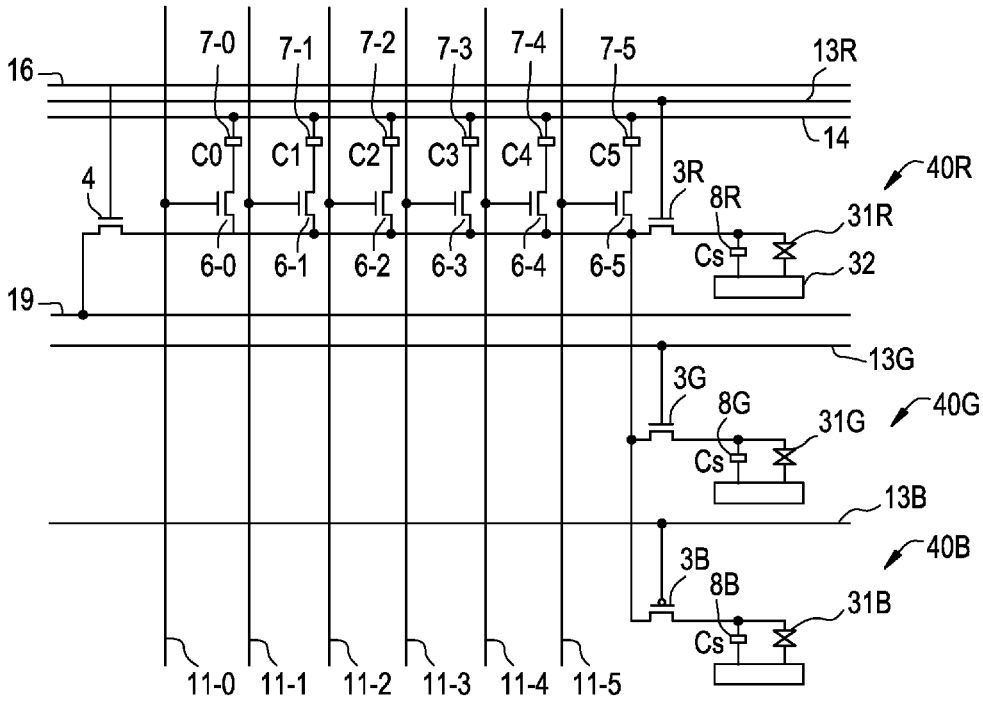
FIG. 11 is a diagram indicating a constitution of a pixel circuit which shares a DA converter with RGB pixels (20R, 20G, 20B).

In the case of pixel circuit of FIG. 9, it is possible to simplify pixel circuit by sharing DAC amongst 3 pixels of RGB. FIG. 11 is an example of sharing 6-bit DAC with RGB pixels (40R, 40G, 40B). The gate terminals of the bit transistors 6-0 to 6-5 are connected to the bit lines 11-0 to 11-5 respectively, the source drain is connected to one end of the coupling capacitances 7-0 to 7-5 with the other end being connected the data enable line 14, and the drain terminal is connected to the drain terminal of the selection transistors 3R, 3G, 3B of RGB pixels and shared. The drain terminal of the reset transistor 4 with the source terminal being connected to the reference line 19 and with the gate terminal being connected to the reset line 15 is connected to the connecting point of the drain terminal of the bit transistors 6-0 to 6-5 and the drain terminal of the selection transistors 3R, 3G, 3B of RGB pixels, and the reset transistor 4 is shared when each pixel is reset. The retentive capacitances 8R, 8G, 8B and the display elements 31R, 31G, 31B are arranged in parallel between the source terminal of the selection transistors 3R, 3G, 3B of each element and the common electrode 32.

When data is written in the order of, for example, RGB using the pixel in FIG. 11, R bit data is set to the bit lines 11-0 to 11-5 first and the coupling capacitance 7 which is active with the corresponding retentive capacitance 8R is reset by turning on the selection transistor 3R and the reset transistor 4 while supplying Vref to the data enable line 14. Subsequently, the reset transistor 4 is turned off and the data enable line 14 is transitioned from Vref to Vdat to reflect DA converted potential Vopt to the retentive capacitance 8R, and the potential is fixed by turning on the selection transistor 3R and retained until the next access. When the same operation is carried out with G and B, the desired image data is written by sharing one DAC with each full color pixel.

Figure 12:
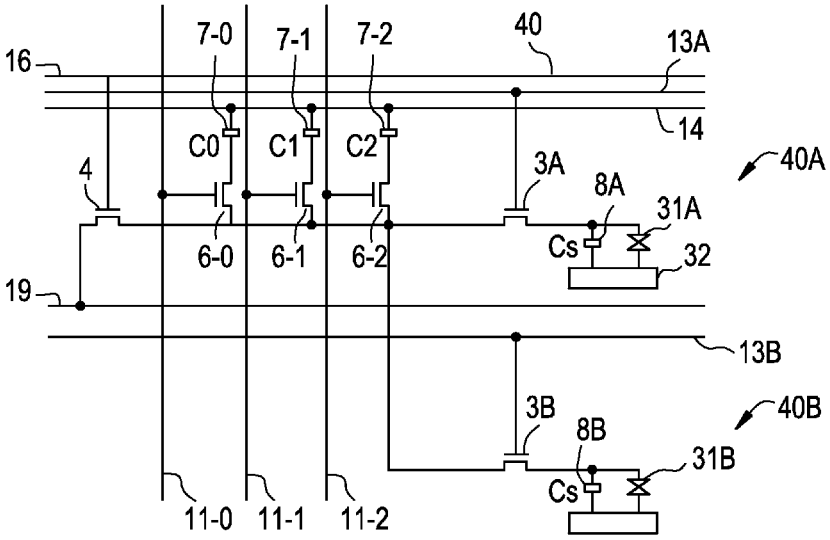
FIG. 12 is a diagram showing a constitution of a pixel circuit which shares a DA converter in sub pixels.

DAC may be shared by installing a plurality of sub pixels to one pixel (any of RGB pixels) as in FIG. 12. FIG. 12 is an example of installing two sub pixels (40A, 40B) within a pixel, and it is possible to install more sub pixels.

The gate terminals of the bit transistors 6-0 to 6-2 are connected to the bit lines 11-0 to 11-2 respectively, the source drain is connected to one end of the coupling capacitances 7-0 to 7-2 with the other end being connected the data enable line 14, and the drain terminal is connected to the drain terminal of the selection transistors 3A and 3B of sub pixels 40A, 40B and shared. To the connecting point, the source terminal of the reset transistor 4 with the source terminal being connected to the reference line 19 and the gate terminal being connected to the reset line is connected and the reset transistor 4 is shared when the sub pixels are reset.

In FIG. 12, the first sub pixel 40A is in charge of displaying the high-order 3 bits while the second sub pixel 40B is in charge of displaying the low-order 3 bits. First, the capacitance value of the coupling capacitance 7 is determined when the high-order 3 bit data is set to the bit lines 11-0 to 11-2. Next, the coupling capacitance 7 and the retentive capacitance 8A are reset by turning on the selection transistor 3A and the reset transistor 4 of the first sub pixel 40A under the condition of setting the data enable line 14 to Vref. Subsequently, the reset transistor 4 is turned off and Vopt with DA converted high-order 3 bits appears to one end of the retentive capacitance 8A when the data enable line 14 is changed from Vref to Vdat, and the potential is retain in the retentive capacitance 8A by turning off the selection transistor 3A.

When writing of the high-order 3 bits are completed, writing of the low-order 3 bits is started. When the low-order 3 bit data is set to the bit lines 11-0 to 11-2 and the capacitance value of the coupling capacitance 7 is determined, the same reset operation is carried out and the Vopt is written into the retentive capacitance 8B of the second sub pixel 40B by changing from Vref to Vdat. Different values are set to Vdat which is given to the data enable line 14 when data is written into the first sub pixel 40A and when data is written into the second sub pixel 40B. This is due to the same reason as in FIG. 5 and 8 times higher voltage is applied to the display element 31 against the second sub pixel 40B for displaying the low-order 3 bit By changing the potential of Vdat, the peak potential is changed easily.

It is also possible to increase the number of pseudo gradation as in FIG. 6 by actively utilizing the sub pixel of FIG. 12. Multi-gradation is obtained even when DAC circuit is eliminated by setting different values for the low-order bit sub pixels 40B and using smoothing effect of the human visions.

Figure 13:
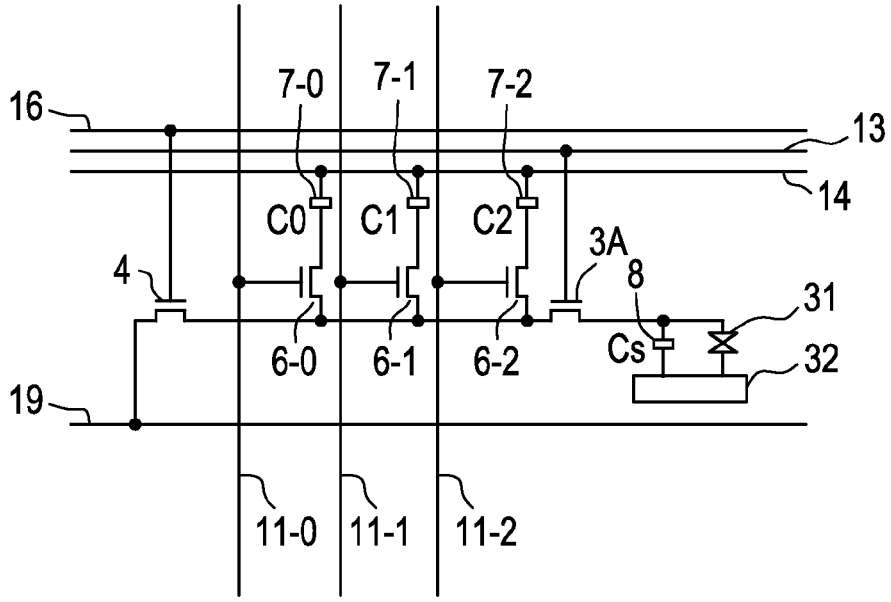
FIG. 13 is a diagram indicating a constructive example of a pixel circuit when a sub frame is used.

DAC can be simplified further as in FIG. 13 using sub frames.

In FIG. 13, 3-bit DAC is constituted inside of pixels, but a multi-gradation that is sufficient for displaying is obtained with the use of a plurality of sub frames as in FIG. 8. When two sub frames with equal periods are introduced as in FIG. 8 (A), 6-bit display is realized by displaying high-order 3 bits in the first sub frame and low-order 3 bits with the second sub frame. In the first sub frame, high-order bit data is supplied to the bit lines 11-0 to 11-2, and a high enable voltage Vdat is supplied to the data enable line 14 after reset. In the second sub frame, reset is executed by supplying low-order bit data to the bit lines 11-0 to 11-2 and Vopt which corresponds to the sub frame is applied to the display element 31 by supplying low Vdat to the data enable line 14. It becomes possible to obtain further multi-gradation by increasing sub frames as in FIG. 8 (B), and the first selection driver 21 is easily simplified by adjusting the sub frame period as in FIG. 8 (C) because there is no necessity to have a variety of enable voltages. However, as in the example of FIG. 7, as long as sub frames are used, frame memory must be introduced and data processing synchronized with sub frame is also necessary.

As explained above, the peripheral circuit can be constituted only with digital circuit by having a DAC built in pixels, eliminating external IC which leads to lowering the cost of a display. It becomes easier to make a display device multifunctional when the cost of a single piece of display is reduced. For example, when the cost of an organic EL display is reduced by introducing the constitution of this embodiment, it becomes easier to introduce a plurality of displays to a single terminal to make it possible to switch amongst a plurality of kinds of displays in accordance with display contents of the terminal for achieving an effective display of images.

Figure 14:
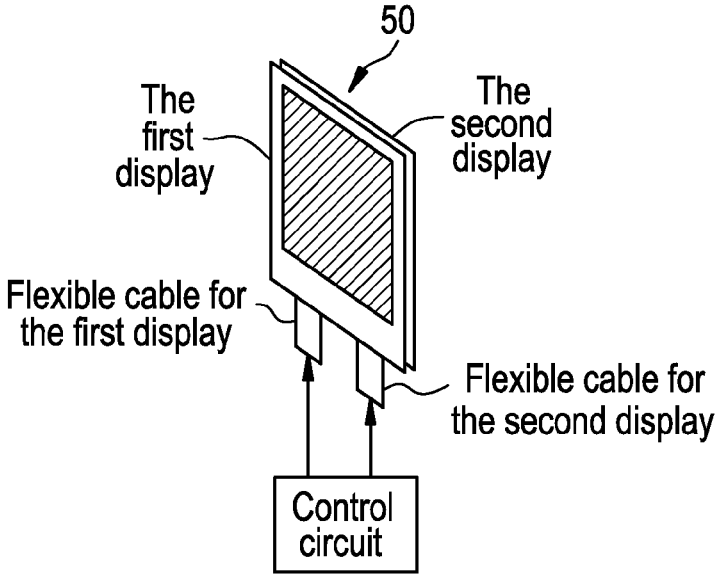
FIG. 14 is a diagram illustrating a constructive example of introducing a plurality of displays to a terminal.

FIG. 14 indicates a dual display 50 to which this idea is introduced. An organic EL display, for example, as the first display is introduced to one side of the dual display 50 of FIG. 14 while electronic paper by an electrophoretic element, for example, is introduced to the back side as the second display. That is, both sides can be used as display screens. The DAC of this embodiment is introduced in the pixels of the both screens, and thus the peripheral circuit can be constituted only with digital circuits and a driver IC is not necessary.

The control circuit not only transmits digital image signals and control signals to the first and second displays but also switches an image between the first and second displays. This control circuit may be built in a dual display module or an external system provides the function of the control circuit. For example, when an image is displayed on an organic EL display, a control circuit transmits image signals to a flexible cable for the first display and the image is received by the first display. During this time, the image signal is not provided to the second display and a display will not be made. On the other hand, when an image is displayed on electronic paper, the control circuit transmits an image to the flexible cable for the second display and the image is received by the second display. During this time, the organic EL display does not display an image and its power is turned off to avoid consuming electricity.

By controlling as above, the dual display 50 is controlled effectively without wasting unnecessary electricity.

Indoor and outdoor visibility of the dual display 50 is improved by installing a self-emissive organic EL display and reflective electronic paper in one display module, and the power consumption can be reduced effectively. The visibility of the self-emissive organic EL display is higher indoor because the peripheral lighting is relatively dark, while the visibility of the reflective electronic paper is higher outdoor and the power consumption is low. The visibility becomes worse at night with electronic paper in outdoor but the visibility is improved when switching the image display to the organic EL. As mentioned above, it is difficult to correspond to a various purposes with a single display due to its advantages and disadvantage originated from display elements, but by installing a display having a plurality of different display characteristics, a display system with a high visibility at low power consumption can be constituted.

The cost of constituting the dual display 50 can be lowered if a single display can be made at a low cost by introducing DAC which is built in pixels. Although an organic EL and electronic paper are used as examples of a single display constituting the dual display 50, liquid crystal may be introduced to one side or both sides may be organic EL.

As explained above, according to this embodiment, in a pixel circuit, digital data is received and converted to analog signals to apply to a gate of a driving transistor or to apply to display elements. Therefore, the effect of characteristic variation of a transistor is controlled even in a data driver, making it possible to manufacture all drivers with TFT.

DESCRIPTION OF THE SYMBOLS

1: display element (organic EL element), 2: driving transistor, 3: selection transistor, 4: reset transistor, 5: light emission control transistor, 6: bit transistor, 7: coupling capacitance, 8: retentive capacitance, 9: power supply line, 10: cathode electrode, 11: bit line, 12: multiplexer, 13: selection line, 14: data enable line, 15: reset line, 16: light emission control line, 17: multiplex line, 18: data line, 19: reference line, 20, 40: pixels, 21: the first selection driver, 22: the second selection driver, 23: data driver, 31: display element, 50: dual display.

The invention claimed is:

1. A circuit of a display device for driving a first and a second organic EL element in which display brightness is controlled by display data having six bits, comprising:

three coupling capacitors connected to a data enable line;

three bit transistors, wherein a first terminal of each bit transistor is electrically connected to a bit line, each bit line conveying one high-order bit or one low-order bit of the display data, and a second terminal of each bit transistor is electrically connected to a corresponding one of the three coupling capacitors;

a first selection transistor with a first terminal electrically connected to a first select line and a second terminal electrically connected to a third terminal of all of the bit transistors;

a second selection transistor with a first terminal electrically connected to a second select line and a second terminal electrically connected to the third terminal of all of the bit transistors;

a first reset transistor with a first terminal electrically connected to a first reset line and a second terminal electrically connected to the third terminal of all of the bit transistors;

a second reset transistor with a first terminal electrically connected to a second reset line and a second terminal electrically connected to the third terminal of all of the bit transistors;

a first driving transistor with a first terminal electrically connected to a third terminal of the first selection transistor and a second terminal electrically connected to a power supply line;

a second driving transistor with a first terminal electrically connected to a third terminal of the second selection transistor and a second terminal electrically connected to the power supply line;

a first retentive capacitor with a first terminal electrically connected to the first terminal of the first driving transistor and a second terminal electrically connected to the second terminal of the first driving transistor;

a second retentive capacitor with a first terminal electrically connected to the first terminal of the first driving transistor and a second terminal electrically connected to the second terminal of the second driving transistor;

a first light emission control transistor with a first terminal electrically connected to a first light emission control line, a second terminal electrically connected to a third terminal of the first driving transistor, and a third terminal electrically connected to a first terminal of the first organic EL element;

a second light emission control transistor with a first terminal electrically connected to a second light emission control line, a second terminal electrically connected to a third terminal of the second driving transistor, and a third terminal electrically connected to a first terminal of the second organic EL element;

wherein either a channel width of the first driving transistor is eight times the channel width of the second driving transistor or a channel length of the first driving transistor is one-eighth the channel length of the second driving transistor; and wherein a voltage corresponding to a threshold voltage of the first driving transistor is retained by the first retention capacitor during a first period when the first light emission control transistor is turned off, the first reset transistor is turned on, and the data enable line is switched between two set voltages, and then, during a second period, a voltage accumulated to the total capacity of the plurality of coupling capacitors according to the difference between the two set voltages applied to the data enable line is applied to the gate of the first driving transistor by the first selection transistor and wherein a voltage corresponding to a threshold voltage of the second driving transistor is retained by the second retention capacitor during a third period when the second light emission control transistor is turned off, the second reset transistor is turned on, and the data enable line is switched between two set voltages, and then, during a fourth period, a voltage accumulated to the total capacity of the plurality of coupling capacitors according to the difference between the two set voltages applied to the data enable line is applied to the gate of the second driving transistor by the second selection transistor.

* * * * *